US007147978B2

(12) United States Patent
Zhu et al.

(10) Patent No.: US 7,147,978 B2
(45) Date of Patent: Dec. 12, 2006

(54) ELECTROPHOTOGRAPHIC PHOTORECEPTORS WITH NOVEL OVERCOATS

(75) Inventors: Jiayi Zhu, Woodbury, MN (US); Kristine A. Fordahl, Hopkins, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 304 days.

(21) Appl. No.: 10/277,268

(22) Filed: Oct. 22, 2002

(65) Prior Publication Data

US 2003/0087172 A1 May 8, 2003

Related U.S. Application Data

(60) Provisional application No. 60/355,718, filed on Oct. 26, 2001.

(51) Int. Cl.
*G03G 5/147* (2006.01)

(52) U.S. Cl. ..... 430/66; 430/67; 430/59.4

(58) Field of Classification Search ..... 430/66, 430/67, 59.4
See application file for complete search history.

(56) References Cited

U.S. PATENT DOCUMENTS

| | | | | |
|---|---|---|---|---|
| 4,203,764 A | | 5/1980 | Tosaka et al. | |
| 4,256,823 A | | 3/1981 | Takahashi et al. | 430/66 |
| 4,390,609 A | | 6/1983 | Wiedemann | |
| 5,292,603 A | * | 3/1994 | Sakai et al. | 430/66 |
| 5,342,718 A | * | 8/1994 | Nousho et al. | 430/58 |
| 5,362,590 A | | 11/1994 | Nakano | 430/89 |
| 5,442,091 A | * | 8/1995 | Wilkerson et al. | 560/33 |
| 6,052,549 A | | 4/2000 | Shimura et al. | 399/176 |
| 6,060,541 A | | 5/2000 | Anderson et al. | |
| 6,067,439 A | | 5/2000 | Kadokura et al. | 399/388 |
| 6,068,957 A | * | 5/2000 | Nair et al. | 430/66 |
| 6,080,518 A | | 6/2000 | Levin et al. | |
| 6,685,985 B1 | * | 2/2004 | Boisseau et al. | 427/180 |

FOREIGN PATENT DOCUMENTS

| | | |
|---|---|---|
| EP | 0866082 | 9/1998 |
| WO | WO00/31194 | 6/2000 |

* cited by examiner

*Primary Examiner*—John L Goodrow
(74) *Attorney, Agent, or Firm*—Patterson, Thuente, Skaar & Christensen, P.A.

(57) ABSTRACT

This invention relates to a photoreceptor that includes:

(a) an overcoat layer comprising at least a rheology modifier and a polymeric resin selected from the group consisting of urethane resins, urethane-epoxy resins, acrylated-urethane resins, urethane-acrylic resins, and a combination thereof.

(b) at least a charge transport compound;

(c) at least a charge generating compound; and (d) an electrically conductive substrate.

20 Claims, No Drawings

ELECTROPHOTOGRAPHIC PHOTORECEPTORS WITH NOVEL OVERCOATS

This application claims the benefit of prov. application 60/355,718 filed on Oct. 26, 2001.

BACKGROUND OF THE INVENTION

1. Field of the Invention

This invention relates to photoreceptors suitable for use in electrophotography and, more specifically, to photoreceptors having novel overcoats comprising a urethane-acrylic resin and a rheology modifier.

2. Background of the Art

In electrophotography, a photoreceptor in the form of a plate, belt, disk, sheet or drum having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and uncharged areas. This pattern is referred to as a latent image. A liquid or solid toner is then deposited in either the charged or uncharged areas to create a toned image on the surface of the photoreceptor. The resulting visible toner image can be transferred to a suitable receiving medium such as paper and film, or the photoreceptor surface can operate as a permanent receptor for the image. The imaging process can be repeated many times when a temporary or intermediate receptor is used.

The photoconductive element can be organic or inorganic. Both single layer and multilayer photoconductive elements have been used. In the single layer embodiment, a charge transport material and charge generating material are combined with a polymeric binder and then deposited on the electrically conductive substrate. In the multilayer embodiment, the charge transport material and charge generating material are in the form of separate layers, each of which can optionally be combined with a polymeric binder, and deposited on the electrically conductive substrate. Two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

A photoreceptor is required to have desired sensitivity and electrical properties depending on an electrophotographic process applied thereto. A photoreceptor subjected to repetitive uses is also required to have an excellent durability and abrasion-resistance against chemicals including the carrier fluid in the toners, electrical forces, and mechanical forces applied thereto during corona charging, toner development, transferring to a receiving medium, and cleaning treatment. Furthermore, the surface layer of the photoreceptor may be contaminated by toners, and therefore it should have a good release property. Lastly, the surface of the photoreceptor should have good electroconductive properties so that charge will not remain on the surface of the photoreceptor after discharge to cause a background problem on prints.

For the surface layer of a photoreceptor to possess the above-mentioned desirable properties, the photoreceptor may be provided with an overcoat to protect the photoconductive element. The typical overcoats comprise fluorinated polymer, silicone or siloxane polymer, fluorosilicone polymer, polyethylene, polypropylene, polyurethane, polycarbonate, polyester, acrylated polyurethane, acrylated polyester, acrylated epoxide resin, or a combination thereof Although these overcoats provide reasonable abrasion-resistance and durability, they may not be good enough for the recent requirement of further improved image quality. This invention provides a protective overcoat layer having further improved properties in respects of chemical, mechanical, and electroconductive properties.

SUMMARY OF THE INVENTION

The invention provides novel overcoat compositions for photoreceptors featuring a combination of good chemical, mechanical, and electroconductive properties. These photoreceptors can be used successfully with liquid toners to produce high quality images. The high quality of the images may be maintained after repeated cycling.

In a first aspect, the invention features a photoreceptor that includes:

(a) an overcoat layer comprising at least a rheology modifier and a polymeric resin selected from the group consisting of urethane resins, urethane-epoxy resins, acrylated-urethane resins, urethane-acrylic resins, and a combination thereof.

(b) at least a charge transport compound;

(c) at least a charge generating compound; and (d) an electrically conductive substrate.

In a second aspect, the invention features an overcoat layer comprising at least a rheology modifier and a polymeric resin selected from the group consisting of urethane resins, urethane-epoxy resins, acrylated-urethane resins, urethane-acrylic resins, and a combination thereof.

Other features and advantages of the invention will be apparent from the following description of the preferred embodiments thereof, and from the claims.

DETAILED DESCRIPTION OF THE INVENTION

The invention features photoreceptors that include novel overcoat having at least a rheology modifier and a polymeric resin selected from the group consisting of urethane resins, urethane-epoxy resins, urethane-acrylic resins, and a combination thereof.

The photoreceptor may be in the form of a plate, drum, disk, sheet or belt, with belts and drums being the preferred embodiments. The photoreceptor may include an electrically conductive substrate and a photoconductive element in the form of a single layer that includes both the charge transport compound and charge generating compound in a polymeric binder. Preferably, however, the photoreceptor includes an electrically conductive substrate and a photoconductive element that is a bilayer construction featuring a charge generating layer and a separate charge transport layer. The charge generating layer may be located intermediate the electrically conductive substrate and the charge transport layer. Alternatively, the photoconductive element may be an inverted construction in which the charge transport layer is intermediate the electrically conductive substrate and the charge generating layer.

The electrically conductive substrate may be flexible, for example in the form of flexible web or a belt, or inflexible, for example in the form of a drum. Typically, a flexible electrically conductive substrate comprises an insulated substrate and a thin layer of electrically conductive materials.

The insulated substrate may be paper or a film forming polymer such as polyethylene terephthalatc, polymide, polysufone, polyethylene naplitbalate, polypropylene, nylon, polyester, polycarbonate, polyvinyl fluorid, polystyrene and the like. Specific examples of supporting substrates included polyethersulfone(STABAR™ S-100, available from ICI), polyvinyl fluoride (TEDLAR™. available from E.I. DuPont de Nemours & Company), polybisphenol-A polycarbonate (MAKROFOL™, available from Mobay Chemical Company) and amorphous polyethylene terephthalate(MELINAR™, available from ICI Americas, Inc.). The electrically conductive materials may be graphite, dispersed carbon black, iodide, conductive polymers such as polypyroles and CALGON® Conductive polymer 261 (commercially available from Calgon Corporation, The., Pittsburgh, Pa.), tals such as aluminum, titanium, chromium, brass, gold, copper, palladium, nickel, or stainless steel, or metal oxide such as tin oxide or indium oxide. Preferably, the electrically conductive material is aluminum. Typically, the photoconductor sub strate will have a thickness adequate to provide the required mechanical stability. For example, flexible web substrates generally have a thickness from a out 0.01 to about 1 mm, while drum substrates generally have a thickness of from about 0.5 mm to bout 2 mm.

The charge generating compound is a material which is capable of absorbing light to generate charge carriers, ch as a dyestuff or pigment. Examples of suitable charge generating compounds include metal-free phthalocyanines (e.g., PROGEN™ 1x-form metal-free phthalocyanine from Zeneca, Inc.), metal phthalocyanines such as titanium phthalocyanine, copper pbthalocyanine, oxytitanium phthalocyanine (also referred to as titanyl oxyphthalocyanine), hydroxygallium phthalocyanine, quarylium dyes and pigments, hydroxy-substituted squarylium pigments, perylimides, polynuclear quinones available from Allied Chemical Corporation under the tradename INDOFAST™ Double Scarlet, INDOFAST™ Violet Lake B, INDOFAST™ Brilliant Scarlet INDOFAST™ Orange, quinacridones available from DuPont under the tradename MONASTRAL® Red, MONASTRAL® Violet and MONASTRAL® Red Y, naphthalene 1 ,4,5,8-tetracarboxylic acid derived pigmeins including the perinones, tetrabenzoporphyrins and tetranaplitbaloporphyrins, indigo- and thioindigo dyes, benzothioxanthene-derivatives, pezylene 3,4,9, 10-tetracarboxylic acid derived pigments, polyazo-pigments including bisazo-, trisazo- and tetralcisazo-pigments, polymethine dyes, dyes containing quinazoline groups, tertiary amines, amorphous selenium, selenium alloys such as seleniurn-telluriuni, selenium-telluri-arsenic and selenium-arsenic, cadmium sulfoselenide, cadmiutriselenide, cadmium sulfide, and mixtures thereof. Preferably, the charge generating compound is oxytitanium plithalocyanine, hydroxygailium phthalocyanine or a combination thereof.

Preferably, the charge generation layer comprises a binder in an amount of from about 10 to about 90 weight percent and more preferably in an amount of from about 20 to about 75 weight percent, based on the weight of the charge generation layer.

There are many kinds of charge transport materials available for electrophotography. Suitable charge transport materials for use in the charge transport layer include, but are not limited to, pyrazoline derivatives, fluorene derivatives, oxadiazole derivatives, stilbene derivatives, hydrazone derivatives, carbazole hydrazone derivatives, triaryl amines, polyvinyl carbazole, polyvinyl pyrene, polyacenaphthylene, or multi-hydrazone compounds comprising at least two hydrazone groups and at least two groups selected from the group of triphenylamine and heterocycles such as carbazole, julolidine, phenothiazine, phenazine, phenoxazine, phenoxathiin, thiazole, oxazole, isoxazole, dibenzo(1,4) dioxine, thianthrene, imidazole, benzothiazole, benzotriazole, benzoxazole, benzimidazole, quinoline, isoquinoline, quinoxaline, indole, indazole, pyrrole, purine, pyridine, pyridazine, pyrimidine, pyrazine, triazole, oxadiazole, tetrazole, thiadiazole, benzisoxazole, benzisothiazole, dibenzofuran, dibenzothiophene, thiophene, thianaphthene, quinazoline, or cinnoline. These multi-hydrazone compounds are described in U.S. Pat. No. 6,066,426, and U.S. application Ser. No. 09/963141, U.S. Provisional Application Nos. 60/311,601, 60/314,055, 60/314,047, 60/317,086, 60/317,088, 60/322,135, 60/322,303, 60/323,782, 60/323,781, 60/325,716, 60/325,714, 60/325,735, 60/325,717, and 60/325,734. The patent, the application, and the provisional applications are hereby incorporated by reference.

The charge transport layer typically comprises a charge transport material in an amount of from about 25 to about 60 weight percent, based on the weight of the charge transport layer, and more preferably in an amount of from about 35 to about 50 weight percent, based on the weight of the charge transport layer, with the remainder of the charge transport layer comprising the binder, and optionally any conventional additives. The charge transport layer will typically have a thickness of from about 10 to about 40 microns and may be formed in accordance with any conventional technique known in the art.

Conveniently, the charge transport layer may be formed by dispersing or dissolving the charge transport material and a polymeric binder in organic solvent, coating the dispersion and/or solution on the respective underlying layer and drying the coating. Likewise, the charge generation layer may be formed by dissolving or dispersing the charge generation compound and the polymeric binders in organic solvent, coating the solution or dispersion on the respective underlying layer and drying the coating.

The binder is capable of dispersing or dissolving the charge transport compound (in the case of the charge transport layer) and the charge generating compound (in the case of the charge generating layer). Examples of suitable binders for both the charge generating layer and charge transport layer include polystyrene-co-butadiene, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly (hydroxyether) resins, polyhydroxystyrene resins, novolak resins, resol resins, poly(phenylglycidyl ether)-co-dicyclopentadiene, copolymers of monomers used in the above-mentioned polymers, and combinations thereof. Polycarbonate binders are particularly preferred. Examples of suitable polycarbonate binders include polycarbonate A which is derived from bisphenol-A, polycarbonate Z, which is derived from cyclohexylidene bisphenol, polycarbonate C, which is derived from methylbisphenol A, and polyestercarbonates.

Suitable vercoat materials for this invention are selected from the group consisting of polyester and/or polyether based urethane resins such as MACEKOTE™ 8539, MACEKOTE™ 5218, and MACEKOTE™ 2641 (the three MACEKOTE ™ series were available from Mace Adhesives & Coatings Co., Inc.), BAYHYDROL™ 110 (available from Bayer Corp. Pittsburg, Pa), Daotan™ VTW DAOTAN™ VTW1210, and DAOTAN™ VTW 6470 (the three DAOTAN™ series were available from Solutia. Inc., Itasca, Ill.), urethane-epoxy resins, acrylated urethane resins such as a DAOTAN™ VTW 6462 (available from Solutia Inc., Itasca, Ill, polycarbonate urethane resins such as BAYOHYDROL™ 121 (available from Bayer Co , Pittsburg, Pa.), and urethane-acrylie hybrid resins with chemically grafted acrylic function ides on polyurethanes such as HYBRIDUR™ 560, HYBRIDUR™ 570, and HYBRIDUR™ 580, (the three HYBRIDUR™ series were available from Air Products and Chemicals, Inc., Allentown, Pa.), and a combination thereof. The preferred overcoat materials are polyester based polyurethanes and urethane-acrylic hybrid resins. These resins include polyurethane backbones to which bridging groups carrying acryloyl moieties are attached (e.g., having hydroxyethylmethacrylate with the hydroxyl group reacting with a moiety on the polyurethane so that the (meth)acryloyl group remains available for activity), or moieties may be reacted into the polyurethane backbone so that acryloyl moieties remain available for reaction. Terminating groups for the polyurethane may also be provided so that the acryloyl functional groups are available for reaction on the ends of the polyurethane polymer. The use of block copolymers or graft copolymers with the polyurethane functionality and the acrylic functionality may also be used, as is known in the art.

The optimal amount of overcoat material is from about 85 to about 99% by weight. The preferred amount of overcoat materials is from 90% to 98% by weight. It is preferred that the overcoat material is dissolved in solvent before applying to the photoconductive element.

The overcoat layer may contain an optional additive. Non-limiting examples of additives in addition to the rheology modifiers are antistatic agents, lubricants, wetting agents, surfactants, coupling agents, release agents, curing agents, polymerization initiators, polymerization promoter, and cross-linking agents. The amounts of these materials can be selected to provide the properties desired. The preferred additive is a rheology modifier.

Rheology modifiers are used generally to adjust or modify the Theological properties of organic or aqueous compositions. Such properties include, without limitation, viscosity, flow rate, stability to viscosity change over time, and the ability to suspend particles in such aqueous compositions. The particular type of modifier used usually depends on the particular organic or aqueous composition to be modified and on the end-use of the modified aqueous composition. Examples of conventional rheology modifiers include thickeners such as cellulosic derivatives, polyvinyl alcohol, sodium polyacrylate, and other organic solvent-soluble or water-soluble macromolecules, and copolymeric emulsions in which monomers with acid groups have been introduced onto the main chain. Such thickeners are used widely in fiber treatment and adhesives. Non-ionic rheology modifiers are those that have a significant group constituting at least 70% of the molecular weight of the compound is a non-ionic moiety. Preferably the group is at least 80%, at leat 90% or more, up to 100% of the compound. Anionic rheology modifiers are those modifiers that have at least one group constituting at least 40% by weight of the compound that contains at least one anionic group. Preferably that group would constitute at least 60%, or at least 70% or at least 80%. Cationic rheology modifiers are those modifiers that have at least one group constituting at least 40% by weight of the compound that contains at least one cationic group. Preferably that group would constitute at least 60%, or at least 70% or at least 80%.

The Theological properties of concentrated dispersions are critical to many important commercial applications. Examples include coatings, inks, films, oils, paints, food additives and pharmaceuticals. Accordingly, the microscopic and macroscopic dispersion structure and the resulting flow properties of such systems are of both scientific and practical interest. The art has established that sub-micron particles in such systems can have a dramatic effect on the rheology of a polymeric solution or fluid. Several physical critical parameters have been identified as influencing its rheology, including the dispersed particle volume fraction, particle size shape and distribution, the continuous phase viscosity and the fluid flow field. By altering or adjusting these microscopic parameters, certain macroscopic phenomena such as elasticity, shear thinning, thixotropic effect and shear thickening can be modified for a particular application or to exhibit a desired property.

Prior art literature on rheology modifiers include Niessner, in U.S. Pat. Nos. 5,149,750 and 5,180,804, disclosed finely divided, water-swellable gel-like, water-swellable copolymers by polymerization of comonomers in the presence of a surfactant. Liu, in U.S. Pat. No. 5,997,855, described a homogeneous terpolymer for hair care use, however, without a crosslinking agent. Kopolow, in U.S. Pat. No. 5,130,121, described personal care compositions containing a stabilized cosmetically-active product obtained by in situ polymerization of a water-soluble vinyl monomer in the presence of discrete microdroplets of a cosmetically-active oil in water. Blankenburg, in U.S. Pat. Nos. 5,635,169 and 6,107,397, described uncrosslinked aqueous copolymer dispersions of nonionic water-soluble monomers with N-vinyl groups and hydrophobic monomers. Steckler, in U.S. Pat. No. 3,878,175, disclosed highly absorbent spongy gel polymer materials by simultaneous copolymerization and partial crosslinking of a comonomer mixture of an alkyl acrylate and a heterocyclic N-vinyl monomer containing a carbonyl functionality in the presence of a hydrophobic liquid diluent in which the final polymer is insoluble. Markus, in U.S. Pat. No. 2,810,716, described a process for making swellable resins by copolymerizing monomers in the presence of a water-soluble non-redox divalent-ion containing salt. Tseng, in U.S. Pat. Nos. 5,393,854 and 5,717,045, disclosed a one-phase, aqueous gel of crosslinked copolymers of vinyl pyrrolidone and dimethylaminoethyl methacrylate for use in hair care products. The crosslinking agent was 1-vinyl-3-(E)-ethylidene pyrrolidone. The gels had a Brookfield viscosity of between 60,000 and 100,000.

Various coupling agents may be employed to rheology modify and graft polymers. Such coupling agents include peroxides, silanes, and azides. Use of poly(sulfonyl azide) to react with polymers is known, for instance the teachings of U.S. Pat. Nos. 3,058,944; 3,336,268; and 3,530,108 include the reaction of certain poly(sulfonyl azide) compounds with isotactic polypropylene or other polyolefins by nitrene insertion into C—H bonds. The product reported in U.S. Pat. No. 3,058,944 is crosslinked. The product reported in U.S. Pat. No. 3,530,108 is foamed and cured with cycloalkane-di (sulfonyl azide) of a given formula. In U.S. Pat. No. 3,336,268 the resulting reaction products are referred to as "bridged polymers" because polymer chains are "bridged" with sulfonamide bridges. The disclosed process includes a mixing step such as milling or mixing of the sulfonylazide and polymer in solution or dispersion then a heating step where the temperature is sufficient to decompose the sulfonylazide (100° C. to 225° C. depending on the azide decomposition temperature). The starting polypropylene polymer for the claimed process has a molecular weight of at least 275,000. Blends taught in U.S. Pat. No. 3,336,268 have up to about 25 percent ethylene propylene elastomer. Similarly, the teachings of Canadian patent 797,917 include rheology modification using from about 0.001 to 0.075 weight percent polysulfonyl azide to modify homopolymer polyethylene and its blend with polyisobutylene.

Many current fabric softener compositions use heteropolysaccharides such as xanthan gums as rheology modifiers. The xanthan gums are dry materials and therefore require a make down step to slurry or disperse the material into the fabric softener composition. In addition, xanthan gums are a source for microbial growth. Microbial contamination causes a loss of viscosity in the fabric softener composition and subsequent spoilage of the product. U.S. Pat. No. 5,114,600 describes a fabric conditioning formulation containing a cationic softener and a cross-linked cationic polymer which is prepared from an ethylenically unsaturated monomer which is crosslinked with 5 to 45 ppm of a cross-linking agent. U.S. Pat. No. 5,869,442 describes a fabric softening composition containing a polyvinylpyridine betaine containing a quaternary nitrogen and a carboxylate salt. PCT application WO 99/06455 describes crosslinked cationic homopolymers as thickening agents for acidic laundry softeners. The crosslinking agent is present in an amount of from not less than 50 to 600 ppm of the homopolymer total weight.

U.S. Pat. No. 6,271,192 (which is incorporated herein by reference for its disclosure of rheology modifiers, generally and with regard to the specific compositions disclosed) describes a polymeric rheology modifier comprising the polymerization product of (i) 5 to 80 weight percent of an alkyl ester of acrylic acid or an alkyl ester of methacrylic acid, wherein the alkyl group has 1 to 18 carbon atoms; (ii) 5 to 80 weight percent of a monomer selected from the group consisting of a vinyl-substituted heterocyclic compound containing at least one nitrogen or sulfur atom, (meth) acrylamide, a mono- or di-alkylamino alkyl(meth)acrylate, and a mono or di-alkylamino alkyl(meth)acrylamide, wherein the alkyl group has 1 to 4 carbon atoms; and 0.1 to 30 weight percent of an associative monomer selected from the group consisting of (a) urethane reaction products of a monoethylenically unsaturated isocyanate and nonionic surfactants comprising $C_1$–$C_4$ alkoxy-terminated, block copolymers of 1,2-butylene oxide and 1,2-ethylene oxide; (b) an ethylenically unsaturated copolymerizable surfactant monomer obtained by condensing a nonionic surfactant with an ethylenically unsaturated carboxylic acid or the anhydride thereof; (c) a surfactant monomer selected from the group consisting of urea reaction product of a monoethylenically unsaturated monoisocyanate with a nonionic surfactant having amine functionality; (d) an allyl ether of the formula $CH_2{=}CR'CH_2\ OA_m\ B_n\ A_p\ R$ wherein R' is hydrogen or methyl, A is propyleneoxy or butyleneoxy, B is ethyleneoxy, n is zero or an integer, m and p are zero or an integer less than n, and R is a hydrophobic group of at least 8 carbon atoms; and (e) a nonionic urethane monomer which is the urethane reaction product of a monohydric nonionic surfactant with a monoethylenically unsaturated isocyanate; and (iv) 0 to 1 weight percent of a cross-linking monomer having at least two ethylenically unsaturated moieties wherein the weight percent of monomers is based on 100 weight percent.

Polymeric rheology modifiers are also particularly useful. The polymeric rheology modifier may be prepared by methods known in the art such as solution polymerization, emulsion polymerization, inverse emulsion polymerization, etc. In a preferred embodiment, the polymeric rheology modifiers are prepared by forming an emulsion utilizing single-stage emulsion polymerization techniques. The monomers, water, free-radical initiator, surfactant in amounts effective to disperse the polymer in the water upon polymerization of the monomers, and from about 0.5 to about 20 weight percent, based on total weight of the emulsion, of an alcohol selected from the group consisting of a $C_2$–$C_{12}$ linear or branched monohydric alcohol and a non-polymeric polyhydric alcohol, such as ethylene glycol, propylene glycol and glycerol, are combined in a polymerization reactor and maintained at a desired temperature and for a period of time which are effective to polymerize the monomers. Preferably the polymerization reaction is initiated at about 30° C., with the contents of the polymerization vessel attaining a temperature of about 60° C. Typically the reaction time is from about I to about 6 hours.

Star polymers, such as those disclosed in U.S. Pat. No. 6,252,014 have also been disclosed as useful rheology modifiers. Other rheology modifiers may be generally described as those components which may increase the viscosity of the fluid. Exemplary polymers include, for example, perfluoropolyethers, fluoroalkyl polyacrylics, and siloxane oils, including those which may be employed as rheology modifiers. Additionally, other molecules may be employed including $C_1$–$C_{10}$ alcohols, $C_1$–$C_{10}$ branched or straight-chained saturated or unsaturated hydrocarbons, ketones, carboxylic acids, N-methyl pyrrolidone, dimethylacetyamide, ethers, fluorocarbon solvents, and chlorofluorocarbon solvents. For the purposes of the invention, the additives are typically utilized up to their solubility limit during the contacting of the substrate.

The rheology modifier employed in the overcoat used in the present invention can be any of a number of well-known substances widely used for this purpose. Non-limiting examples of suitable rheology modifier include nonionic rheology modifiers such as ACRYSOL™ RM-8W, ACRYSOL™ RM-825, ACRYSOL™ RM-2020, ACRYSOL™ TT-678, ACRYSOL™ SCT-270, ACRYSOL™ SCT-275, and ionic rheology modifiers such as ACRYSOL™ RM-5, ACRYSOL™ TT-615, ACRYSOL™ ASE-60, and ACRYSOL™ ASE-95. All the above-mentioned Acrysol™ are from Rohm and Haas Company, Philadelphia, Pa. The preferred rheology modifiers are ethylene-oxide based urethanes such as ACRYSOL™ RM-825, ACRYSOL™ RM-2020, and ACRYSOL™ SCT-275.

The optimal amount of rheology modifier is generally from about 1 to about 15% by total weight of the overcoat layer. The preferred amount of rheology modifier is from 2% to 10% by total weight of the overcoat layer. The rheology modifier should be dissolved in a dilute solution before addition to the overcoat solution in order to prevent the precipitation of the overcoat material.

The overcoat layer can be applied on the photoconductive element by any conventional coating techniques such as spray coating, die coating, roll coating, knife coating, curtain coating, knurl coating, dip coating, ring coating, rotary atomizing, and extrusion.

The photoreceptor may include other layers in addition to the overcoat layer. Such layers are well-known and include, for example, barrier layers, adhesive layers, and sub-layers. The overcoat layer forms the uppermost layer of the photoconductor element with the barrier layer sandwiched between the overcoat layer and the photoconductive element. The adhesive layer locates and improves the adhesion between the barrier layer and the overcoat layer or other layers that can use increased adhesion. The sub-layer is a charge blocking layer and locates between the electrically conductive substrate and the photoconductive element. The sub-layer may also improve the adhesion between the electrically conductive substrate and the photoconductive element.

Suitable barrier layers include coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above organic binders optionally may contain small inorganic particles such as fumed silica, silica, titania, alumina, zirconia, or a combination thereof. The typical particle size is in the range of 0.001 to 0.5 micrometers, preferably 0.005 micrometers. A preferred barrier layer is a 1:1 mixture of methyl cellulose and methyl vinyl ether/maleic anhydride copolymer with glyoxal as a crosslinker.

Typical adhesive layers include film forming polymers such as polyester, polyvinylbutyral, polyvinylpyrolidone, polyurethane, polymethyl methacrylate, poly(hydroxy amino ether) and the like. Preferably, the adhesive layer is poly(hydroxy amino ether). If such layers are utilized, they preferably have a dry thickness between about 0.01 micrometer and about 5 micrometers.

Typical sub-layers include polyvinylbutyral, organosilanes, hydrolyzable silanes, epoxy resins, polyesters, polyamides, polyurethanes, silicones and the like. Preferably, the sub-layer has a dry thickness between about 20 Angstroms and about 2,000 Angstroms.

The overcoat layers of this invention, and photoreceptors including these overcoat layers, are suitable for use in an imaging process with either dry or liquid toner development. Liquid toner development is generally preferred because it offers the advantages of providing higher resolution images and requiring lower energy for image fixing compared to dry toners. Liquid toners are well-known. Liquid toners typically include a colorant, a resin binder, a charge director, and a carrier liquid. Typically, the colorant, resin, and the charge director form the toner particles.

Non-limiting examples of liquid toner suitable for this invention are described in U.S. Pat. Nos. 5,652,282, 5,698,616, 5,886,067, and 6,103,781, and U.S. Provisional Application Nos. 60/258,784, 60/258,784, and 60/311,645. These patents and provisional applications are hereby incorporated by reference.

The invention will now be described further by way of the following examples.

EXAMPLES

Comparative Example A

Comparative Example A was an electrographic photoreceptor sheet prepared by the method described in Example 2 of U.S. Pat. No. 6,066,426. A plurality of sheets were prepared and each sheet was about 40 cm×200 cm.

Example 1

Example 1 was prepared by coating on Comparative Example A an overcoat solution containing HYBRIDUR™-580 (commercially available from Air Products and Chemicals, Inc., Allentown, Pa.). The overcoat solution was prepared by diluting 10 g of HYBRIDUR-580 with 33 g of de-ionized water and 39 g of ethanol. The mixture was shaken on a mechanical shaker for 5~10 minutes and was then coated onto Comparative Example A by using a knife coater with 40 micron of gap space. The coated sample was dried in an oven at 110° C. for 10 min.

Example 2

Example 2 was prepared by the same procedure for Example 1 above, except that HYBRIDUR™-580 was replaced by HYBRIDUR™-570 (commercially available from Air Products and Chemicals, Inc., Allentown, Pa.).

Example 3

Example 3 was prepared by the same procedure for Example 1 above, except that ACRYSOL™ SCT-275 (a rheology modifier, commercially available from Rohm and Haas Company, Philadelphia, Pa.) in an amount of 10% by weight of the total weight of the solid of the composition was added to the mixture.

Example 4

Example 4 was prepared by the same procedure for Example 2 above, except that ACRYSOL™ SCT-275 (a rheology modifier, commercially available from Rohm and Haas Company, Philadelphia, Pa.) in an amount of 10% by weight of the total weight of the solid of the composition was added to the mixture.

Example 5

Example 5 was prepared by the same procedure for Example 4 above, except that HYBRIDUR™-570 was replaced by HYBRIDUR™-560.

Example 6

Example 6 was prepared by the same procedure for Example 3 above, except that ACRYSOL™ SCT-275 was replaced by ACRYSOL™ RM-825.

Example 7

Example 7 was prepared by the same procedure for Example 3 above, except that ACRYSOL™ SCT-275 was replaced by ACRYSOL™ RM-2020.

Example 8

Example 8 was prepared by the same procedure for Example 4 above, except that the amount of ACRYSOL™ SCT-275 was reduced to 0.5% by weight of the total weight of the solid of the composition.

Example 9

Example 9 was prepared by the same procedure for Example 4 above, except that the amount of ACRYSOL™ SCT-275 was reduced to 1.0% by weight of the total weight of the solid of the composition.

Example 10

Example 10 was prepared by the same procedure for Example 4 above, except that the amount of ACRYSOL™ SCT-275 was reduced to 2.0% by weight of the total weight of the solid of the composition.

Example 11

Example 11 was prepared by the same procedure for Example 4 above, except that the amount of ACRYSOL™ SCT-275 was reduced to 5.0% by weight of the total weight of the solid of the composition.

Example 12

Example 12 was prepared by the same procedure for Example 4 above, except that the amount of ACRYSOL™ SCT-275 was increased to 15.0% by weight of the total weight of the solid of the composition.

Example 13

Example 13 was prepared by the same procedure for Example 4 above, except that the amount of ACRYSOL™ SCT-275 was increased to 20.0% by weight of the total weight of the solid of the composition.

Example 14

Example 14 was prepared by the same procedure for Example 4 above, except that the amount of ACRYSOL™ SCT-275 was increased to 40.0% by weight of the total weight of the solid of the composition.

Comparative Example B

Comparative Example B was a single layer organophotoreceptor having a 76.2 micron (3 mil) thick polyester substrate having a layer of vapor-coated aluminum (commercially obtained from CP Films, Martinsville, Va.). The coating solution for the single layer organophotoreceptor was prepared by pre-mixing 2.4 g of 20% (4-n-butoxycarbonyl-9-fluorenylidene) malononitrile solution in tetrahydrofuran, 6.66 g of 25% MPCT-10 (a charge transfer material, commercially obtained from Mitsubishi Paper Mills, Tokyo, Japan) solution in tetrahydrofuran, 7.65 g of 12% polyvinyl butyral resin (BX-1, commercially obtained from Sekisui Chemical Co. Ltd., Japan) in tetrahydrofuran. To the above mixture was then added 0.74 g of a CGM mill-base containing 19% of titanyl oxyphthalocyanine and a polyvinyl butyral resin (BX-5, commercially obtained from Sekisui Chemical Co. Ltd., Japan) at a ratio of 2.3:1. The CGM mill-base was obtained by milling 112.7 g of titanyl oxyphthalocyanine (commercially obtained from H. W. Sands Corp., Jupiter, Fla.) with 49 g of the polyvinyl butyral resin (BX-5) in 651 g of MEK on a horizontal sand mill (model LMC12 DCMS, commercially obtained from Netzsch Incorporated, Exton, Pa.) with 1-micron zirconium beads using recycle mode for 4 hours. After mixing on a mechanical shaker for ~1 hour, the single layer coating solution was coated onto the substrate described above using a knife coater with a gap space of 94 microns followed by drying in an oven at 110° C. for 5 minutes. The dry layer thickness was 10 microns.

Example 15

Example 5 was prepared by the same procedure for Example 1 above, except that HYBRIDUR™ 580 was replaced by DAOTAN™ 6470 (commercially available from Solutia Inc., Itasca, Ill.) and that Comparative Example A was replaced by Comparative Example B.

Example 16

Example 16 was prepared by the same procedure for Example 15 above, except that ACRYSOL™ SCT-275 (a rheology modifier, commercially available from Rohm and Haas Company, Philadelphia, Pa.) in an amount of 10% by weight of the total weight of the solid of the composition was added to the mixture.

Example 17

Example 17 was prepared by the same procedure for Example 15 above, except that DAOTAN™ 6470 was replaced by BAYHYDROL™ 110 (commercially available from Bayer Corp, Pittsburg, Pa.) and that the overcoat solution was prepared by diluting 10 g BAYHYDROL™ 110 with 27 g of deionized water and 23 g of ethanol.

Example 18

Example 18 was prepared by the same procedure for Example 17 above, except that ACRYSOL™ SCT-275 (a rheology modifier, commercially available from Rohm and Haas Company, Philadelphia, Pa.) in an amount of 10% by weight of the total weight of the solid of the composition was added to the mixture.

Example 19

Example 19 was prepared by the same procedure for Example 17 above, except that BAYHYDROL™-110 was replaced by BAYHYDROL™ 121 (commercially available from Bayer Corp, Pittsburgh, Pa.).

Example 20

Example 20 was prepared by the same procedure for Example 19 above, except that ACRYSOL™ SCT-275 (a rheology modifier, commercially available from Rohm and Haas Company, Philadelphia, Pa.) in an amount of 10% by weight of the total weight of the solid of the composition was added to the mixture.

Example 21

Example 21 was prepared by the same procedure for Example 17 above, except that BAYHYDROL™-110 was replaced by MACEKOTE™ 8539 (commercially available from Mace Adhesives & Coatings Co., Inc.

Example 22

Example 22 was prepared by the same procedure for Example 21 above, except that ACRYSOL™ SCT-275 (a rheology modifier, commercially available from Rohm and Haas Company, Philadelphia, Pa.) in an amount of 10% by weight of the total weight of the solid of the composition was added to the mixture.

Example 23

Example 23 was prepared by the same procedure for Example 17 above, except that BAHYDROL™-110 was replaced by MACEKOTE™ 5218, (commercially available from Mace Adhesives & Coatings Co., Inc.

Example 24

Example 24 was prepared by the same procedure for Example 23 above, except that ACRYSOL™ SCT-275 (a rheology modifier, commercially available from Rohm and Haas Company, Philadelphia, Pa.) in an amount of 10% by weight of the total weight of the solid of the composition was added to the mixture.

Abrasion Test

The abrasion test was done by following ASTM D-4060 "Standard Test Method for Abrasion Resistance of Organic Coatings By the Taber Abraser". Each of the examples prepared above was cut into disks of 10 cm in diameter and was abraded by using a Taber Abraser (Model-505, made by Taber Industries, North Tonawanda, N.Y.) with CS-10F rubber wheels under a load of 125 g for 100 cycles. After the test was done, the sample was examined visually for the amount of abrasion on the sample.

Electrostatic Test

Each of the examples prepared above was tested for its electrostatic cycling performance. Each example was cut into sheets of 50 cm long by 8.8 cm wide. Two sets of data were collected on each example: one set was collected on fresh cut sheets at ambient condition (i.e., about 25 degree C. and 45% to 75% of relative humidity) while the other set was collected with the same sheets after exposed to high humidity (i.e., samples were stored in an environmental chamber set at 90% relative humidity and 30 degree C. for 24 hours).

A test series was designed to evaluate the electrostatic cycling performance of a photoreceptor sheet at ambient by fastening the pre-cut samples around an aluminum drum (50 cm circumference). During the test, the drum rotated at a rate of 8.1 cm/sec. while the erase, corona charging, and laser discharge stations were located at approximately −80 degree, 45 degree, and 90 degree positions, respectively, from the top of the drum. The first electrostatic probe (Trek 344 electrostatic meter, from Trek Inc., Medina N.Y.) was located immediately after the laser discharge station and the second identical probe at 180 degree from the top of the drum.

Each sheet was completely charged for three cycles (drum rotations); discharged with the laser at 780 nm, 600 dpi on the forth cycle to obtained the discharge voltage; completely charged for the next three cycles to obtain charge acceptance voltage; discharged with only the erase lamp at 720 nm on the eighth cycle to obtain residue voltage; and, finally, completely charged for the last three cycles. Charge acceptance ($V_{acc}$) and discharge voltages ($V_{dis}$) were recorded by the electrostatic probes described above. The difference between $V_{acc}$ and $V_{dis}$ is ΔV.

TABLE 1

Results of Crazing, Abrasion, and Electrostatic Tests of Comparative Example A and Examples 1–14.

| | | Electrostatic Test Results | | |
|---|---|---|---|---|
| Sample ID | Abrasion | $V_{acc}$ | $V_{dis}$ | ΔV |
| Comparative Example A | Heavy | 580 | 40 | 540 |
| Example 1 | Light | 652 | 147 | 505 |
| Example 2 | Moderate | 638 | 116 | 522 |
| Example 3 | Light | 622 | 49 | 573 |
| Example 4 | Light | 621 | 67 | 554 |
| Example 5 | Moderate | 643 | 68 | 575 |
| Example 6 | N/A | 645 | 107 | 538 |
| Example 7 | Light | 643 | 93 | 550 |
| Example 8 | Moderate | 645 | 148 | 497 |
| Example 9 | Moderate | 670 | 126 | 544 |
| Example 10 | Moderate | 625 | 87 | 538 |

TABLE 1-continued

Results of Crazing, Abrasion, and Electrostatic Tests of Comparative Example A and Examples 1–14.

| | | Electrostatic Test Results | | |
|---|---|---|---|---|
| Sample ID | Abrasion | $V_{acc}$ | $V_{dis}$ | ΔV |
| Example 11 | Moderate | 615 | 67 | 548 |
| Example 12 | Moderate | 570 | 156 | 414 |
| Example 13 | Light | 636 | 219 | 417 |
| Example 14 | N/A | 629 | 380 | 249 |

TABLE 2

Results of Electrostatic Tests of Comparative Example B and Examples 15–24.

| | Electrostatic Test Results | | |
|---|---|---|---|
| Sample ID | $V_{acc}$ | $V_{dis}$ | ΔV |
| Comparative Example B | 658 | 39 | 619 |
| Example 15 | 694 | 193 | 501 |
| Example 16 | 675 | 85 | 590 |
| Example 17 | 701 | 173 | 528 |
| Example 18 | 663 | 82 | 581 |
| Example 19 | 725 | 201 | 524 |
| Example 20 | 705 | 86 | 619 |
| Example 21 | 725 | 234 | 491 |
| Example 22 | 685 | 57 | 628 |
| Example 23 | 735 | 209 | 526 |
| Example 24 | 680 | 55 | 625 |

What is claimed is:

1. A photoreceptor comprising:

(a) an overcoat layer comprising at least an ethylene-oxide based rheology modifier and a polymeric resin selected from the group consisting of urethane resins, urethane-epoxy resins, acrylated-urethane resins, urethane-acrylic resins, and a combination thereof, (b) at least a charge transport compound;

(c) at least a charge generating compound; and (d) an electrically conductive substrate.

2. A photoreceptor according to claim 1, wherein said ethylene-oxide based rheology modifier comprises an ethylene-oxide based urethane.

3. A photoreceptor according to claim 1, wherein said polymeric resin comprises a urethane-acrylic resin.

4. A photoreceptor according to claim 3, wherein said ethylene-oxide based rheology modifier comprises an ethylene-oxide based urethane.

5. A photoreceptor according to claim 1, wherein said charge transport compound is selected from the group consisting of pyrazoline derivatives, fluorine derivatives, oxadiazole derivatives, stilbene derivatives, hydrazone derivatives, carbazole hydrazone derivatives, triaryl amines, polyvinyl carbazole, polyvinyl pyrene, polyacenaphthylene, multi-hydrazone compounds, and a combination thereof.

6. A photoreceptor according to claim 1, wherein said charge generating compound is selected the group consisting of oxytitanium phthalocyanine, hydroxygallium phthalocyanine and a combination thereof.

7. An overcoat layer comprising at least an ethylene-oxide based rheology modifier and a polymeric resin selected from the group consisting of urethane resins, urethane-epoxy resins, acrylated-urethane resins, urethane-acrylic resins, and a combination thereof.

8. An overcoat layer according to claim 7, wherein said ethylene-oxide based rheology modifier comprises an ethylene-oxide based urethane.

9. An overcoat layer according to claim 7, wherein said polymeric resin comprises a urethane-acrylic resin.

10. An overcoat layer according to claim 9, wherein said ethylene-oxide based rheology modifier comprises an ethylene-oxide based urethane.

11. An photoreceptor comprising:

(a) an electrically conductive substrate;

(b) a photoconductive element on the electrically conductive substrate, the photoconductive element comprising at least a charge transport compound and at least a charge generating compound (c) an overcoat layer on the photoconductive element, the overcoat layer comprising at least an ethylene-oxide based rheology modifier and a polymeric resin selected from the group consisting of urethane resins, urethane-epoxy resins, acrylated-urethane resins, urethane-acrylic resins, and a combination thereof.

12. A photoreceptor according to claim 11, wherein said ethylene-oxide based rheology modifier comprises an ethylene-oxide based urethane.

13. A photoreceptor according to claim 11, wherein said polymeric resin comprises a urethane-acrylic resin.

14. A photoreceptor according to claim 13, wherein said ethylene-oxide based rheology modifier comprises an ethylene-oxide based urethane.

15. A photoreceptor according to claim 11, wherein said charge transport compound is selected from the group consisting of pyrazoline derivatives, fluorine derivatives, oxadiazole derivatives, stilbene derivatives, hydrazone derivatives, carbazole hydrazone derivatives, triaryl amines, polyvinyl carbazole, polyvinyl pyrene, polyacenaphthylene, multi-hydrazone compounds, and a combination thereof.

16. A photoreceptor according to claim 11, wherein said charge generating compound is selected from the group consisting of oxytitanium phthalocyanine, hydroxygallium phthalocyanine and a combination thereof.

17. A photoreceptor according to claim 11, wherein said the photoconductive element further comprises a second charge transport material.

18. A photoreceptor according to claim 1, wherein the amount of said ethylene-oxide based rheology modifier is between 1 wt % and 15 wt % with respect to the total weight of the overcoat layer.

19. A overcoat layer according to claim 7, wherein the amount of said ethylene-oxide based rheology modifier is between 1 wt % and 15 wt % with respect to the total weight of the overcoat layer.

20. A photoreceptor according to claim 11, wherein the amount of said ethylene-oxide based rheology modifier is between 1 wt % and 15 wt % with respect to the total weight of the overcoat layer.

* * * * *